US006499299B2

(12) United States Patent
Propernick

(10) Patent No.: US 6,499,299 B2
(45) Date of Patent: Dec. 31, 2002

(54) APPARATUS AND METHOD FOR DIAGNOSING PRESSURE-RELATED PROBLEMS IN TURBOCHARGED ENGINES

(76) Inventor: Ronald Propernick, 42 W. Del Rio Dr., Tempe, AZ (US) 85282

( * ) Notice: Subject to any disclaimer, the term of this patent is extended or adjusted under 35 U.S.C. 154(b) by 0 days.

(21) Appl. No.: 09/834,206

(22) Filed: Apr. 13, 2001

(65) Prior Publication Data

US 2002/0148224 A1 Oct. 17, 2002

(51) Int. Cl.[7] ..... F02D 23/00
(52) U.S. Cl. ..... 60/602; 60/324; 73/49.7
(58) Field of Search ..... 60/602, 606, 611, 60/324; 123/184.21; 73/49.7; 55/274

(56) References Cited

U.S. PATENT DOCUMENTS 4,197,711 A * 4/1980 Furhmann et al. ..... 60/602
4,342,220 A * 8/1982 Catchpole et al. ..... 73/49.7
4,519,210 A * 5/1985 Iwamoto et al. ..... 60/602
5,152,145 A * 10/1992 Miotke et al. ..... 60/602
5,275,636 A * 1/1994 Dudley et al. ..... 55/274
5,299,423 A * 4/1994 Shiozawa et al. ..... 60/611
5,705,737 A * 1/1998 Liao ..... 73/49.7
5,755,101 A * 5/1998 Free et al. ..... 60/602
6,016,655 A * 1/2000 Boswell ..... 60/324

* cited by examiner

*Primary Examiner*—Thomas Denion
*Assistant Examiner*—Thai-Ba Trieu
(74) *Attorney, Agent, or Firm*—Jeffrey Weiss; Harry M. Weiss; Weiss, Moy & Harris, P.C.

(57) ABSTRACT

An apparatus and method for diagnosing mechanical problems in turbocharged engines. In its preferred embodiment, the apparatus consists of a boot that is coupled to a turbocharge system—preferably at the air inlet thereof. The, apparatus further includes a source of air pressure that may be delivered to the turbocharge system, a first pressure gauge to measure the pressure of the air that is being delivered, and a second pressure gauge to measure the pressure of the air within the turbocharge system. Under pressure, and with the engine off, the turbocharge system can be inspected for leaks. In addition, under pressure, the operation of turbocharge system components—such as the wastegate valve/diaphragm and the boost sensor—can also be inspected.

16 Claims, 3 Drawing Sheets

APPARATUS AND METHOD FOR DIAGNOSING PRESSURE-RELATED PROBLEMS IN TURBOCHARGED ENGINES

BACKGROUND OF THE INVENTION

1. Field of Invention

This invention relates generally to engine diagnosis and, more specifically, to an apparatus and method for diagnosing pressure-related and other problems in turbocharged systems.

2. Background of the Invention

Turbocharged systems are used, particularly on diesel engines, to increase engine power by compressing the air that enters the engine's combustion chambers. They operate by utilizing the hot exhaust gases exiting the cylinders to spin a compressor wheel (also known as an impeller), pressurizing air drawn into the system and routing that pressurized air, into the engine.

A typical turbocharged system generally includes a number of additional components. Too much impeller speed can cause impeller shaft or bearing failure. To address this, the turbocharger uses a waste gate valve, which allows exhaust gas to bypass the turbine once the ideal pressure level or boost is exceeded. This has the effect of reducing impeller speed, and thus helps prevent shaft and bearing failures.

Additionaly, if the turbocharged air is too hot when it enters the engine , engine knocking and reduced output can be caused. To address this, the turbocharger tipically includes an intercooler (or charge air cooler), which cools the turbocharged air before it enters the cylinders.

A turbocharged system's efficiency can be diminished by leaks at any point in the turbocharged system. Such leaks can occur in a number of places, including in the boots and clamps utilized in the system, in seams, in gaskets or O-rings, in the intercooler, and at the point where the turbocharge system couples to the intake manifold. Currently, such leaks are tested for by starting the engine and listening to the sounds the turbo system makes—in an effort to detect higher pitched sounds that would indicate the presence of a leak. This can be difficult, however, because the engine noise can interfere with a mechanic's ability to hear such higher pitched sounds. Moreover, other problems, such as improper functioning of the wastegate or of the boost sensor, can also resist ready diagnosis.

A need therefore existed for an apparatus and method that simulates running pressure conditions in a turbocharge system when the engine is off, to permit the more effective diagnosis of pressure-related and other mechanical problems in a turbocharge system. The present invention satisfies these needs and provides other, related, advantages.

SUMMARY OF THE INVENTION

It is an object of the present invention to provide an apparatus and method that simulates running pressure conditions in a turbocharged system with the engine off, so as to permit the more effective diagnosis of pressure-related mechanical problems in a turbocharge system.

It is a further object of the present invention to provide an apparatus and method that simulates running pressure conditions in a turbocharged system with the engine off, so as to permit the more effective diagnosis of problems with the wastegate and boost sensor in a turbocharged system.

BRIEF DESCRIPTION OF THE PREFERRED EMBODIMENTS

In accordance with one embodiment of the present invention, an apparatus for diagnosing potential mechanical problems in turbocharged systems is disclosed. The apparatus comprises, in combination: a source of pressurized air; and means for delivering said pressurized air to any portion of a turbocharged system for a vehicle engine in a substantially air-tight manner when said vehicle engine is in an off condition.

In accordance with another embodiment of the present invention, an apparatus for diagnosing potential problems in turbocharged systems is disclosed. The apparatus comprises, in combination: a source of pressurized air; means for delivering said pressurized air to any portion of a turbocharged system for a vehicle engine in a substantially air-tight manner when said vehicle engine is in an off condition; wherein said means for delivering said pressurized air comprises a boot adapted to be positioned over an exposed end of a turbo inlet following removal of an air filter from said turbo inlet; a first display gauge in communication with said source of pressurized air and adapted to display the pressure of said pressurized air as it is provided to said any portion of a turbocharged system; and a second display gauge adapted to display the pressure within said any portion of a turbocharged system.

In accordance with still another embodiment of the present invention, a method for diagnosing potential mechanical problems in turbocharged systems is disclosed. The method comprises: providing a source of pressurized air; providing means for delivering said pressurized air to any portion of a turbocharged system for a vehicle engine in a substantially air-tight manner when said vehicle engine is in an off condition; coupling said delivering means to said turbocharged system; delivering said pressurized air to said turbocharged system; inspecting said turbocharged system for mechanical problems.

The foregoing and other objects, features, and advantages of the invention will be apparent from the following, more particular, description of the preferred embodiments of the invention, as illustrated in the accompanying drawings.

DETAILED DESCRIPTION OF THE PREFERRED EMBODIMENTS

Figure 3:
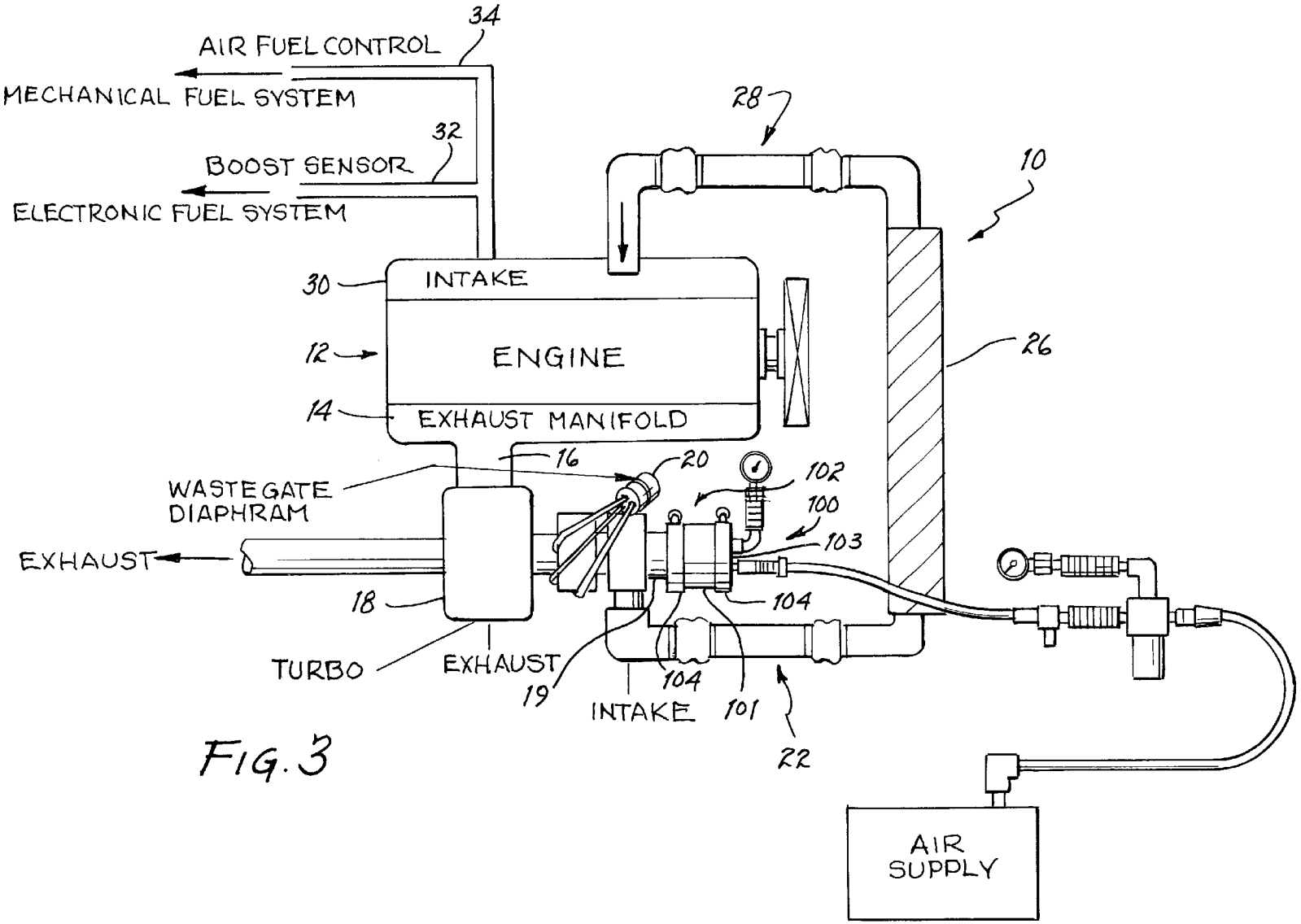
FIG. 3 is a plan view of a turbocharged system, with the diagnosis apparatus of the present invention coupled thereto.
Figure 4:
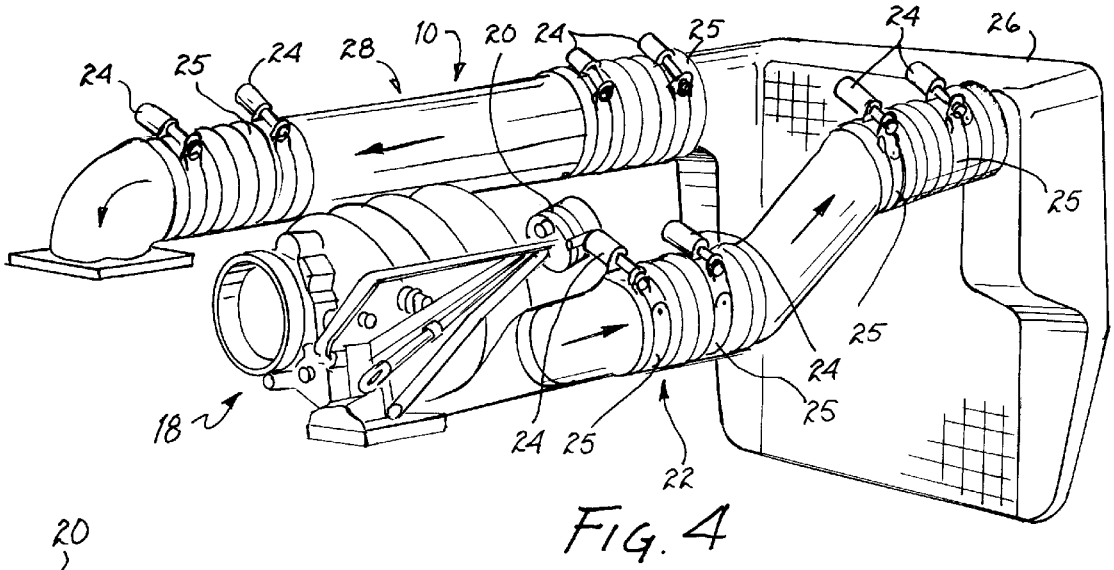
FIG. 4 is a perspective view of a turbocharged system, including the charge air cooler.
Figure 5:
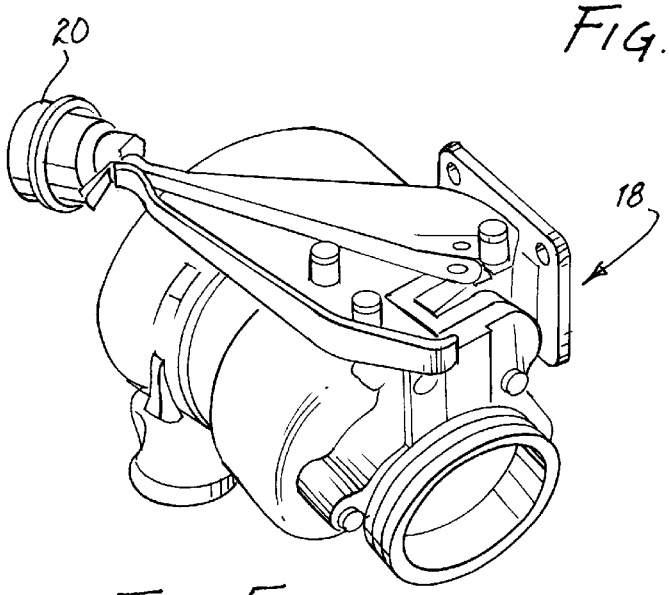
FIG. 5 is a perspective view of a turbocharger with a wastegate.
Figure 6:
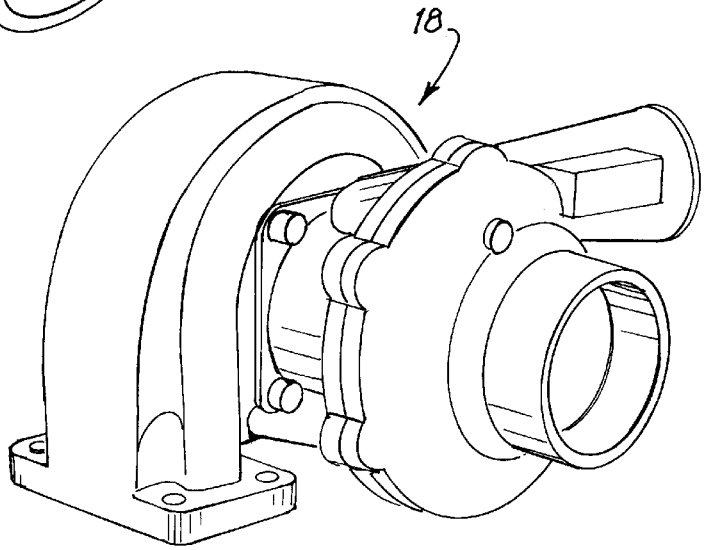
FIG. 6 is a perspective view of a turbocharger without a wastegate.

Referring first to FIGS. 3 and 4, a typical turbocharged system 10 is described. The turbocharge system 10 is coupled to an engine 12, at the exhaust manifold 14. (Air is also permitted to pass into the turbo housing 18 at a second end through a turbo inlet 19, at an end of which is located an air filter (not shown).) An exhaust pipe 16 carries exhaust gases from the exhaust manifold 14 to the turbo housing 18. Inside the turbo housing 18 (not shown), exhaust gases exiting the engine will spin a turbine, then exit the engine through the exhaust pipe at the back of the turbo housing 18. A shaft connecting the turbine wheel to the compressor wheel will spin the compressor wheel. Air drawn into the turbo housing 18 through the turbo inlet 19 (which air will pass through an air filter (not shown)) is then compressed by the compressor wheel.

A wastegate valve or diaphragm 20 ("wastegate 20") is coupled to the turbo housing 18. The wastegate 20 allows an amount of gas to bypass the turbine when ideal boost is exceeded. This has the effect of reducing compressor wheel speed, so as to reduce shaft and bearing failures.

After compression, the turbocharged air passes through a first length of tubing 22 to an intercooler (or charge air cooler) 26. The intercooler 26 cools the turbocharged air before it reaches the combustion chamber in the engine 12. The cooling of the compressed air raises its oxygen content, allowing it to burn fuel more cleanly. As can be seen in FIGS. 3 and 4, the first length of tubing 22 consists of sections of straight and angled tubes, joined by a series of clamps 24 over rubber boots 25. Gaskets, O-rings and seals (not shown) are also commonly used in the joining together of the straight and angled sections of the first length of tubing 22 and the coupling of the first length of tubing 22 to the turbo housing 18 and the intercooler 26.

From the intercooler 26, the turbocharged air next passes through a second length of tubing 28. Like the first length of tubing 22, the second length of tubing 28 consists of sections straight and angled tubes, joined by a series of clamps 24 over rubber boots 25. Gaskets, O-rings and seals (not shown) are also commonly used in the joining together of the straight and angled sections of the second length of tubing 28 and the coupling of the second length of tubing 28 to the intercooler 26 and the intake manifold 30 of the engine 12.

Where the turbocharge system 10 is part of an engine 12 fed by an electronic fuel system, it will typically also be coupled to a boost sensor 32, which measures changes in the intake manifold pressure. Where the turbocharge system 10 is part of an engine 12 fed by a mechanical fuel system, it will typically also be coupled to an air fuel control 34.

Figures 1, 2:
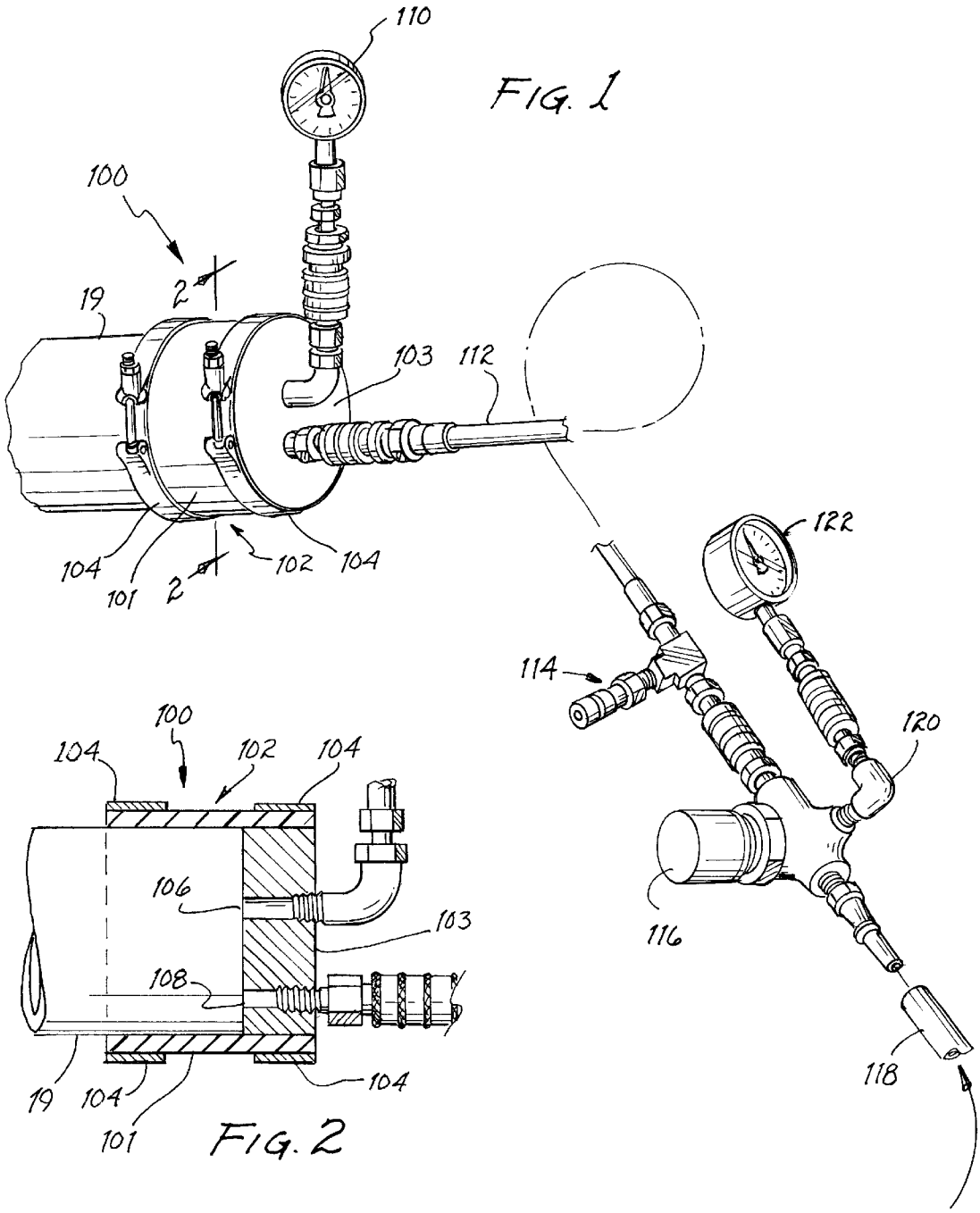
FIG. 1 is a perspective view of the diagnosis apparatus of the present invention coupled to a turbocharger inlet.
FIG. 2 is a cross-sectional view of the apparatus shown in FIG. 1, taken along line 2—2.

Turning now to FIGS. 1–3, the diagnosis apparatus 100 ("apparatus 100") of the present invention is shown and described. The apparatus 100 consists of a boot 102. The boot 102 preferably consists of a tube 101, preferably formed of material of the kind typically used in automotive hoses, such as silicone, which tube 101 is fitted at one end in an air-tight manner to a plate 103. The tube 10i is dimensioned to be fitted over the turbo inlet 19, after the removal therefrom of the air filter (not shown). So as to secure the tube 101 in a substantially air-tight manner to the turbo inlet 19, at least one and preferably two adjustable clamps 104 are positioned around the tube 101. Attaching the diagnosis apparatus 100 to the turbocharge system 10 by fitting the tube 101 over the turbo inlet 19 is only one method of so attaching the apparatus 100—and any boot configuration (and any material) permitting such coupling to the turbo inlet 19 or to any other portion of the turbocharge system 10 so as to permit the delivery thereto of pressurized air would be encompassed within the meaning of the term "boot."

Located in the plate 103 and passing therethrough are a first opening 106 and a second opening 108. The first opening 106 is dimensioned to receive a first air pressure gauge 110. The second opening 108 is dimensioned to receive a hose 112, which hose 112 is in turn coupled to a first opening in a valve 114. The valve 114 is coupled at a second opening thereof to an air adjustment valve 116, which air adjustment valve 116 is coupled to a hose 118 leading to a pressurized air source (not shown). Coupled either to a third opening in the valve 114 or to a valve 120 coupled to the air adjustment valve 116 is a second air pressure gauge 122.

STATEMENT OF OPERATION

The first step when using the apparatus 100 to diagnose mechanical problems with a turbocharge system 10 is to couple the apparatus 100 thereto. Preferably, this is accomplished by removing the air filter (not shown) and positioning the boot 102 over the turbo inlet 19. (As discussed below, for certain tests, it will be preferable to position the boot 102 at a different part of the turbocharge system 10.) Once in position, the boot 102 should be secured in a substantially air-tight manner by tightening the clamps 104 therearound. Throughout the diagnosis process, the engine 12 is preferably not running.

Once the boot 102 is in position, the air intake system is pressurized by opening the air adjustment valve 116, permitting air from the pressurized air source (not shown) to pass therethrough, through the rear of the boot 102, and into the turbocharged system 10. The air pressure of the air coming from the pressurized air source is determined by examination of the second air pressure gauge 122. Air pressure within the turbocharge system 10 is determined by examination of the first air pressure gauge 110. Of course, the intake system should not be pressurized beyond the specifications for the particular engine 12 at rated load.

With the system pressurized, the user may now inspect the turbocharge system 10 for any leaks. The user will want to pay attention to the first air pressure gauge 110, to determine if the turbocharge system 10 is holding pressure, and will want to pay particular attention to such leak-prone areas as the rubber boots 25, clamps 24, seams, O-rings, diaphragms, intercooler 26, and the intake manifold 30.

With the system pressurized, the air fuel control 34 can be tested by removing its top plug (not shown), and visually inspecting the operation of the diaphragm therein to determine if it is functioning correctly—and performing any necessary adjustment where improper functioning is detected. Operation of the wastegate 20 is tested by observing actuation of the valve in response to pressure, and performing necessary adjustments as appropriate when testing the wastegate 20, depending on the particular turbocharge system 10, it may be necessary to couple the boot 102 in a more direct manner (such as to the air inlet tube at the air fuel control connection (not shown)), since some turbocharge systems 10 will not permit the pressurized air to pass sufficiently quickly from the turbo inlet 19 to the wastegate 20 to permit testing. It may also be necessary, when testing the wastegate 20, to use additional attachment hardware so as to permit suitable attachment.

The boost sensor (not shown) on engines with electronic fuel systems can be tested for accuracy in the following manner. With the engine off and the ignition key on, diagnostic equipment is coupled to the boost sensor. The apparatus 100 is then pressurized; and the user compares the pressure shown on the first air pressure gauge 110 with that shown on the diagnostic equipment to determine if the boost sensor is accurately measuring pressure.

While the invention has been particularly shown and described with reference to preferred embodiments thereof, it will be understood by those skilled in the art that the foregoing and other changes in form and details may be made therein without departing from the spirit and scope of the invention.

I claim:

1. An apparatus for diagnosing potential mechanical problems in turbocharged systems comprising, in combination:

a source of pressurized air; and means for delivering said pressurized air to a turbocharged system for a vehicle engine in a substantially air-tight manner when said vehicle engine is in an off condition and thereby pressuring said turbocharged system from a point proximate entry of exhaust gases into said turbocharged system to a point proximate exit of pressurized air from said turbocharged system.

2. The apparatus of claim 1 further comprising a first display gauge in communication with said source of pressurized air and adapted to display the pressure of said pressurized air as said pressurized air is provided to the turbocharged system.

3. An apparatus for diagnosing potential mechanical problems in turbocharged systems comprising, in combination:

a source of pressurized air; and means for delivering said pressurized air to a turbocharged system for a vehicle engine in a substantially air-tight manner when said vehicle engine is in an off condition;

wherein said means for delivering said pressurized air comprises a boot adapted to be positioned over an exposed end of a turbo inlet following removal of an air filter from said turbo inlet.

4. The apparatus of claim 3 further comprising at least one adjustable clamp positioned about an exterior portion of said boot.

5. An apparatus for diagnosing potential mechanical problems in turbocharged systems comprising, in combination:

a source of pressurized air; and means for delivering said pressurized air to a turbocharged system for a vehicle engine in a substantially air-tight manner when said vehicle engine is in an off condition;

a first display gauge in communication with said source of pressurized air and adapted to display the pressure of said pressurized air as it is provided to said the turbocharged system; and a second display gauge adapted to display the pressure within the turbocharged system.

6. An apparatus for diagnosing potential problems in turbocharge systems comprising, in combination:

a source of pressurized air;

means for delivering said pressurized air to a turbocharged system for a vehicle engine in a substantially air-tight manner when said vehicle engine is in an off condition;

wherein said means for delivering said pressurized air comprises a boot adapted to be positioned over an exposed end of a turbo inlet following removal of an air filter from said turbo inlet;

a first display gauge in communication with said source of pressurized air and adapted to display the pressure of said pressurized air as it is provided to the turbocharged system; and a second display gauge adapted to display the pressure within the turbocharged system.

7. A method for diagnosing potential mechanical problems in turbocharged systems comprising:

providing a source of pressurized air;

providing means for delivering said pressurized air to a turbocharged system for a vehicle engine in a substantially air-tight manner when said vehicle engine is in an off condition;

coupling said delivering means to said turbocharged system;

delivering said pressurized air to said turbocharged system;

pressuring said turbocharged system from a point proximate entry of exhaust gases into said turbocharged system to a point proximate exit of pressurized air from said turbocharged system; and inspecting said turbocharged system for mechanical problems.

8. The method of claim 7 further comprising providing a first display gauge in communication with said source of pressurized air and adapted to display the pressure of said pressurized air as said pressurized air is provided to the turbocharged system.

9. The method of claim 7 further comprising coupling said delivery means to an air inlet tube at an air fuel control connection.

10. The method of claim 7 further comprising inspecting the turbocharged system for leaks.

11. The method of claim 7 further comprising inspecting operation of a wastegate.

12. A method for diagnosing potential mechanical problems in turbocharge systems comprising:

providing a source of pressurized air;

providing means for delivering said pressurized air to a turbocharged system for a vehicle engine in a substantially air-tight manner when said vehicle engine is in an off condition;

wherein said means for providing pressurized air comprises a boot adapted to be positioned over an exposed end of a turbo inlet following removal of an air filter from said turbo inlet;

coupling said delivering means to said turbocharged system;

delivering said pressurized air to said turbocharged system; and inspecting said turbocharged system for mechanical problems.

13. The method of claim 12 further comprising providing at least one adjustable clamp positioned about an exterior portion of said boot.

14. A method for diagnosing potential mechanical problems in turbocharged systems comprising:

providing a source of pressurized air;

providing means for delivering said pressurized air to a turbocharged system for a vehicle engine in a substantially air-tight manner when said vehicle engine is in an off condition;

providing a first display gauge in communication with said source of pressurized air and adapted to display the pressure of said pressurized air as said pressurized air is provided to the turbocharged system;

providing a second display gauge adapted to display the pressure within the turbocharged system;

coupling said delivering means to said turbocharged system;

delivering said pressurized air to said turbocharged system;

pressuring said turbocharged system from a point proximate entry of exhaust gases into said turbocharged system to a point proximate exit of pressurized air from said turbocharged system; and inspecting said turbocharged system for mechanical problems.

15. The method of claim 14 further comprising monitoring said second display gauge to determine said pressure within the turbocharged system.

16. A method for diagnosing potential mechanical problems in turbocharge systems comprising:

providing a source of pressurized air;

providing means for delivering said pressurized air to a turbocharged system for a vehicle engine in a substantially air-tight manner when said vehicle engine is in an off condition;

providing a first display gauge in communication with said source of pressurized air and adapted to display the pressure of said pressurized air as said pressurized air is provided to the turbocharged system;

providing a second display gauge adapted to display the pressure within the turbocharged system;

coupling said delivering means to said turbocharged system;

delivering said pressurized air to said turbocharged system;

inspecting said turbocharged system for mechanical problems;

turning on an ignition coupled to said engine;

coupling diagnostic equipment to a boost sensor;

delivering said pressurized air to the turbocharged system; and comparing said pressure displayed on said second display gauge with pressure shown on said diagnostic equipment as representing pressure detected by said boost sensor.

* * * * *